US005781642A

United States Patent [19]

Tanaka et al.

[11] Patent Number: 5,781,642

[45] Date of Patent: Jul. 14, 1998

[54] SPEAKER SYSTEM

[75] Inventors: Shoji Tanaka, Kobe; Katsuhiko Iimura, Higashiosaka, both of Japan

[73] Assignee: Matsushita Electric Industrial Co., Ltd., Osaka, Japan

[21] Appl. No.: 842,442

[22] Filed: Apr. 24, 1997

[30] Foreign Application Priority Data

Apr. 24, 1996 [JP] Japan ..... 8-102390

[51] Int. Cl.[6] ..... H04R 25/00

[52] U.S. Cl. ..... 381/159; 381/99

[58] Field of Search ..... 381/24, 59, 88, 381/89, 90, 99, 159, 182, 150; 181/144, 145, 147, 148

[56] References Cited

U.S. PATENT DOCUMENTS 4,015,089 3/1977 Ishii et al. ..... 381/99

FOREIGN PATENT DOCUMENTS 4-59839 9/1992 Japan .

*Primary Examiner*—Huyen Le

*Attorney, Agent, or Firm*—McDermott, Will & Emery

[57] ABSTRACT

A speaker system that has a first speaker containing a first speaker unit in a first cavity and a second speaker containing a speaker unit wherein the crossover frequency of the first speaker and second speaker is $f_{cr}$: $1.4 \leqq Q_1 \leqq 10$, $f_1 < f_2$, $f_1 \leqq f_{cr} \leqq f_1 \times \{(Q_1^2+1.2\times Q_1)/(Q_1^2-2.5)\}^{0.5} \times k$, $1 \leqq k \leqq \{(Q_1/(Q_1-1.4)\}^{2.5}$, where the fundamental resonance frequency of the first speaker is $f_1$, the resonance sharpness is $Q_1$, and the fundamental resonance frequency of the second speaker is $f_2$.

9 Claims, 15 Drawing Sheets

SPEAKER SYSTEM

BACKGROUND OF THE INVENTION

The present invention relates to a speaker system.

To cope with the recent trend to higher sound quality, smaller size, and lower price of AV appliances in the background of digitization, a speaker system or sub-woofer enhanced in low range reproduction capacity of low cost and smaller inner volume is being demanded. Such AV appliances are not limited to exclusive speaker systems and system stereos, but include car-mount stereos, televisions, electronic musical instruments, and PA systems.

This means that there is a need to enhance the low range reproduction capacity means and to raise the output sound pressure level (efficiency), while maintaining a specific cabinet inner volume and a specific low range reproduction limit frequency (also known as cut-off frequency, referring to a frequency lowered by 3 dB from the level of the band range of flat sound pressure). Also, there is a need to extend the low range reproduction limit frequency while maintaining a specific cabinet inner volume and a specific output sound pressure level. Further, it means that there is a need to reduce the inner volume of the cabinet while maintaining a specific output sound pressure level and a specific low range reproduction limit frequency.

Accordingly, aside from the closed cabinet speaker, various bass reproduction speaker systems (bass reproduction cabinet system) have been proposed, including the bass reflex type, acoustic labyrinth type, and resonant tube type. However, each system had its own merits and demerits. In general, there has not been a significant difference comprehensively in the low range reproduction capacity. Bass reflex type speaker systems have been widely employed because the cost increase was relatively small.

A conventional bass reflex type is described below while referring to the drawings. FIG. 12 is a structural drawing of an example of speaker system of a conventional bass reflex type, and FIG. 13 is its frequency characteristic diagram.

As shown in FIG. 12, a woofer 56 and a tweeter 57 are provided in a bass reflex type cabinet 53 having a port 53*c*. An electrical signal applied from an input terminal 55 is separated into band ranges in a network 54, and is distributed into the woofer 56 and tweeter 57.

As shown in FIG. 13, the woofer 56 reproduces from a low range reproduction limit frequency $f_c$ to a crossover frequency $f_{cr}$, and the tweeter 57 reproduces a band over $f_{cr}$. Usually, the crossover frequency $f_{cr}$ is about 1 kHz to several kHz in such a two-way speaker system, or hundreds of Hz to about 3 kHz, and several kHz, in a three-way speaker system.

In FIG. 12, the characteristic resonance of the bass reflex type between air equivalent compliance in the cabinet 53 and air equivalent mass of the port 53*c* (also known as anti-resonance) occurs, and around this resonance frequency (generally called, anti-resonance frequency), the bass mainly from the port 53*c* is radiated efficiently. Generally, the anti-resonance frequency is set lower than the fundamental resonance frequency when the same speaker unit is contained in the closed cabinet of same volume.

In this constitution, by making use of anti-resonance of the port 53*c*, generally, the low range reproduction limit frequency can be lowered by about 5 to 15% than in the closed cabinet speaker system of same inner volume. To the contrary, when the low range reproduction limit frequency is same, the output sound pressure level can be raised by about 1 dB generally than in the closed cabinet speaker system.

However, in the conventional speaker system, the low range reproduction capacity is limited, and the cost cannot be lowered. These problems and reasons are discussed below while referring to the drawings.

FIG. 14 is a frequency characteristic diagram of a bass reflex type speaker system, showing the changes of the sound pressure and frequency characteristic by changing the BL of the speaker unit as the woofer (where B is the magnetic flux density of magnetic circuit, and L is the voice coil effective conductor length). The larger the BL value, the stronger is the magnetic circuit.

As shown in FIG. 14, there is an optimum BL value giving a flat frequency characteristic. When the BL is increased further, the level of the medium and treble range is heightened, but the level of the bass range is lowered, or when the BL is decreased further, the level of the bass range is raised, but a peak is in the bass range and the level of the medium and treble range is lowered.

In particular, high efficiency cannot be achieved simultaneously in both the bass range and the medium and treble ranges. Specifically, the output sound pressure level cannot be heightened over the whole band range while maintaining a flat frequency characteristic. This is because the driving force and output sound pressure level are proportional to the BL, while the electromagnetic braking resistance $R_e=(BL)^2/R_v$, ($R_v$, is a voice coil DC resistance) increases substantially when the BL becomes larger, so that the Q of the low range resonance drops.

Herein, assume the support system stiffness of the speaker unit is in an ideal state, being sufficiently smaller than the equivalent stiffness of the air in the cabinet. Supposing the effective vibration area of the speaker unit to be S and the effective vibration mass to be $m_0$, the output sound pressure level is proportional to $S\times BL/m_0$, and in a specific inner volume, moreover, the fundamental resonance frequency $f_0$ (the bass reflex type has both resonance frequency and anti-resonance frequency, and $f_0$ refers to the resonance frequency of the higher frequency side) is proportional to $(S/m_0)^{0.5}$. Supposing the mechanical resistance of the vibration system of the speaker unit to be Rm, the Q of low range resonance is $Q=2\times\pi\times f_0\times m_0/(Rm+Re)$, but since Rm is sufficiently smaller as compared with the electromagnetic braking resistance Re, Q is almost proportional to $f_0\times m_0/R_e$.

When the effective vibration area S is multiplied by N times, the sound pressure becomes N times, but also $f_0$ becomes N times and Q of resonance also N times. First, to return $f_0$ to the original frequency, when $m_0$ is multiplied by $N^2$ times, the Q of the resonance becomes $N^2$ times. Consequently, by multiplying the BL by N times, the Q of the resonance can be returned to the original value. Incidentally, since $m_0$ is $N^2$ times, the sound pressure becomes $1/N^2$ times, and further the BL is N times, and it is also N times, and finally if the effective vibration area is increased N times, the sound pressure returns to the initial value.

Therefore, within a specific inner volume, the output sound pressure level cannot be raised in the whole band range while maintaining a flat frequency characteristic, and there is a limit value. To the contrary, when the output sound pressure level is kept constant, there is a limit value in the low range reproduction limit frequency. Or, when the output sound pressure level and low range reproduction limit frequency are constant, there is a limit value in the inner volume (not to be made smaller). That is, a limit is present in the low range reproduction capacity, and it holds true in all speaker systems operating in the concentrated acoustic constant system in the bass range, such as closed type and bass reflex type systems.

FIG. 15 shows changes of sound pressure and frequency characteristic when the BL of the speaker unit is changed in the closed type speaker system. In the closed type speaker system, a most flat frequency characteristic is obtained when the Q of the minimum resonance is 0.7. That is, the same tendency as in the bass reflex type speaker system is noted.

In the conventional closed type speaker, from the aspects of hearing sensation and characteristics, the Q of the minimum resonance is selected around 0.5 to 1.0, and the largest value of Q did not exceed about 1.1. This is because a boomy sound quality is formed around the fundamental resonance frequency when Q becomes larger. That is, as the frequency characteristic, only the vicinity of the fundamental resonance frequency builds up, and the transient characteristic is impaired.

If the frequency characteristic is flat in spite of heightened Q, the transient characteristic is not impaired so much (for example, as in the case of an electric filter of a steep cut- off characteristic). In one speaker unit, however, it cannot be realized.

Although the bass reflex type speaker system is higher in low range reproduction capacity than in the closed type speaker system, as known well, a larger BL value is needed than in the closed type speaker system in order to obtain a flat frequency characteristic. Therefore, a powerful magnetic circuit using a large field system is needed, which results in an increase in cost.

BRIEF SUMMARY OF THE INVENTION

To solve the problems of the prior art, it is hence an object of the invention to present a speaker system further enhanced in the low range reproduction capacity than in the conventional limit and low in cost.

To achieve the object, the speaker system of the invention comprises a first speaker containing a first speaker unit in a first cavity, and a second speaker containing a second speaker unit in a second cavity, being driven together with the first speaker, wherein the following condition is satisfied: supposing the fundamental resonance frequency of the first speaker is $f_1$, the resonance sharpness is $Q_1$, the fundamental resonance frequency of the second speaker is $f_2$, and the crossover frequency of the first speaker and second speaker is $f_{cr}$:

$$1.4 \leqq Q_1 \leqq 10$$

$$f_1 < f_2$$

$$f_1 \leqq f_{cr} \leqq f_1 \times \{(Q_1^2 + 1.2 \times Q_1)/(Q_1^2 - 2.5)\}^{0.5} \times k$$

$$1 \leqq k \leqq \{(Q_1)/(Q_1 - 1.4)\}^{2.5}$$

In this constitution, since the Q of the low range resonance of the first speaker is very high, a high output sound pressure level is obtained in the bass range. Moreover, since the second speaker independent of the first speaker is used, a high output sound pressure level is obtained also above the bass and medium range. Further, since the two speakers cross over in the optimum condition, the frequency characteristic near the crossover frequency is flat, so that a flat frequency characteristic of high output sound pressure level is obtained over the entire region.

Besides, since the first speaker has a very high value of Q of low range resonance, the field system of the most expensive speaker unit is very small, so that the cost can be lowered.

The invention itself, together with further objects and attendant advantages, will best be understood by reference to the following detailed description taken in conjunction with the accompanying figures.

DETAILED DESCRIPTION OF THE INVENTION

Figure 1:
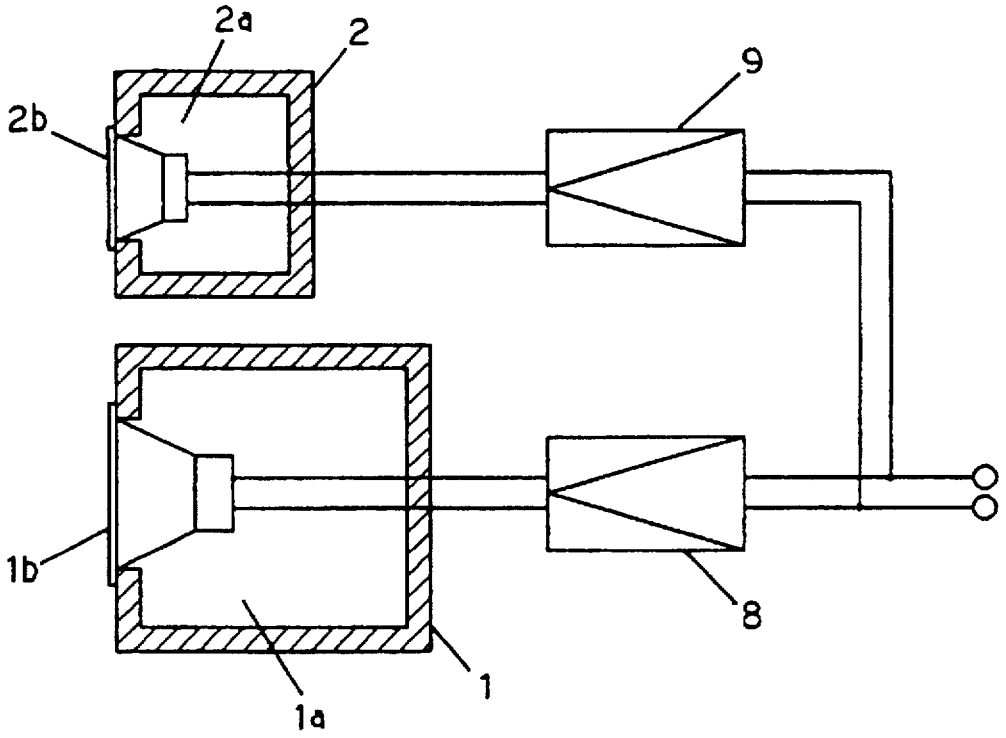
FIG. 1 is a block diagram of a speaker system in a first embodiment of the invention.

Referring now to the drawings, embodiments of the invention are described in detail below.

First exemplary embodiment

FIG. 1 is a structural diagram of a speaker system in a first embodiment of the invention. In FIG. 1, a first speaker 1 measures 15 cm in width, 15 cm in height, 15 cm in depth, and 10 mm in thickness. A first cavity 1*a* is a closed box with an inner volume of 2.0 liters.

A first speaker unit 1*b* is a woofer with an aperture of 14 cm. Its impedance is 6Ω. The magnet measures 60 mm in outer diameter, 32 mm in inner diameter and 9 mm in thickness. The BL is 4.3. The effective vibration radius is 47 mm. The effective vibration mass is 28 g. The independent fundamental resonance frequency is 30 Hz. The mechanical resonance sharpness ( Qm ) is 8.0, and the voice coil DC resistance is 4.8 Ω. The voice coil is an eight-layer winding type of 25 mm in diameter. The inductance is very large, and the sound pressure level of high frequency range is attenuated.

The first speaker unit 1*b* is contained in the first cavity 1*a* to form the first speaker 1. The fundamental resonance frequency $f_1$, of the first speaker 1 is 62 Hz, and the resonance sharpness $Q_1$, is 2.1.

A second speaker 2 measures 9 cm in width, 13 cm in height, 11.5 cm in depth, and 10 mm in thickness. A second cavity 2*a* is a closed box with an inner volume of 0.7 liter.

A second speaker unit 2b is a full range speaker with an aperture of 7 cm. Its impedance is 4Ω. The output sound pressure level is 80.5 dB/W. At input of 1 W of 6 Ω impedance, a sound pressure level of 82 dB is obtained.

The second speaker unit 2b is contained in the second cavity 2a to form the second speaker 2. The fundamental resonance frequency $f_2$ of the second speaker 2 is about 140 Hz.

In this embodiment, the first speaker 1 and second speaker 2 are driven together by individual power amplifiers 8, 9 (bi-amplifier system). The frequency characteristic of both power amplifiers 8, 9 is flat. They are identical in input sensitivity and maximum output electric power, and acoustically it is same as when the speakers are connected parallel and driven by one power amplifier. In the first embodiment, the polarity of the first speaker and second speaker is opposite. The crossover frequency $f_{cr}$ of the first speaker 1 and second speaker 2 is set at about 120 Hz.

Figure 2:
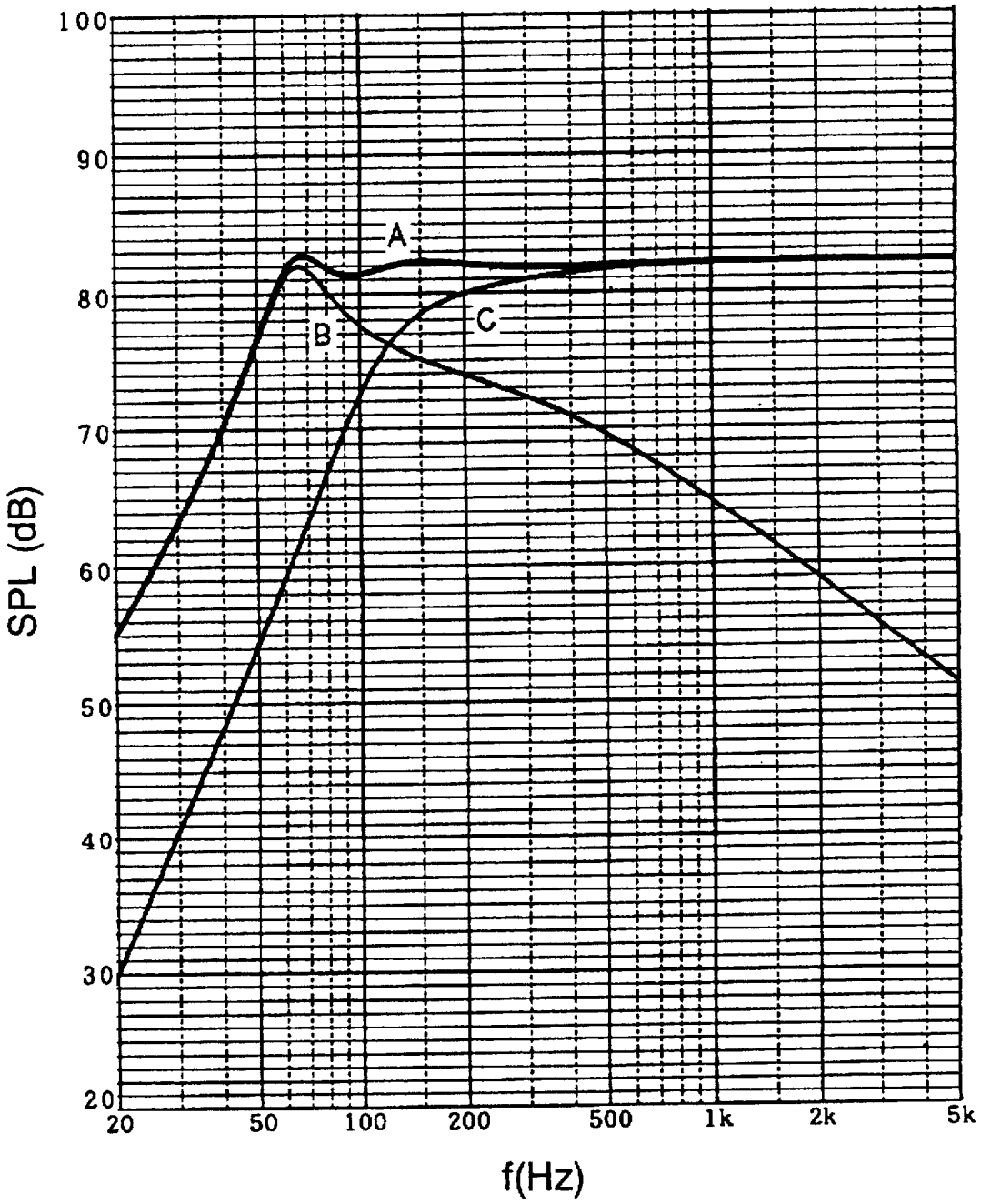
FIG. 2 is a frequency characteristic diagram of the speaker system in the first embodiment.

In the speaker system of the first embodiment, the action and effect thereof are described below while referring to the drawing. FIG. 2 is a frequency characteristic diagram by simulation of the speaker system of the embodiment, in which the ordinate axis denotes the sound pressure level SPL, and the abscissa axis represents the frequency f.

In FIG. 2, B is the sound pressure frequency characteristic of the first speaker 1, C is the sound pressure frequency characteristic of the second speaker 2, A is the total sound pressure frequency characteristic of both speakers. The input voltage is equivalent to 1 W at impedance of 6 Ω. These characteristics are provided with infinite baffle.

Since the resonance sharpness $Q_1$ of the first speaker 1 is as high as 2.1, a high output sound pressure level of about 82 dB can be obtained near the fundamental resonance frequency $f_1$ of 62 Hz, as indicated by B in FIG. 2. In the conventional speaker system, the output sound pressure level was limited to around 79 dB at the inner volume of 2.7 liters (total inner volume of first and second cavities) and the same fundamental resonance frequency.

In this embodiment, the high range of the first speaker unit 1b is attenuated by making use of the inductance of the voice coil. Hence, if the high range characteristic of the first speaker unit 1b is disturbed, interference with the second speaker unit 2b does not occur in the high range.

If the value of $Q_1$ of the first speaker 1 is too small, the effect for enhancing the output sound pressure level is lost. It was clarified by computer simulation analysis that $Q_1$ should be about 1.4 or more. On the other hand, if $Q_1$ is extremely large, the transient characteristic is poor, and it causes a problem in the hearing sensation. It was experimentally clarified that the upper limit is about 10.

However, since the fundamental resonance frequency $f_2$ of the second speaker 2 is defined as $f_2>f_1$, it is not necessary to lower the $f_2$, so that the output sound pressure level can be heightened easily. In this embodiment, as indicated by C in FIG. 2, this output sound pressure level is matched nearly with the output sound pressure level around $f_1$.

Further, the second speaker 2 is not required to reproduce in bass range, and the aperture of the second speaker unit 2b may be small. Hence, the inner volume of the second cavity 2a may be small, and the total inner volume does not increase so much. Therefore, together with the effect of a marked effect of enhancing the output sound pressure level, the output sound pressure level is about 3 dB higher, as compared with the conventional speaker system of same total inner volume.

In this embodiment, the crossover frequency $f_{cr}$ is about 120 Hz, and it is set so as to satisfy the condition of $$1.4 \leqq Q_1 \leqq 10$$

$$f_1 < f_2$$

$$f_1 \leqq f_{cr} \leqq f_1 \times \{(Q_1^2+1.2\times Q_1)/(Q_1^2-2.5)\}^{0.5} \times k$$

$$1 \leqq k \leqq \{(Q_1/(Q_1-1.4)\}^{2.5}$$

and therefore a flat frequency characteristic is obtained even near the crossover frequency, as indicated by A in FIG. 2.

The above setting condition of crossover frequency was first obtained by the present analysis. Also it was confirmed by analysis by the newly developed computer simulation and the experiment of measurement that a flat frequency characteristic is obtained in this condition.

Specifically, by combining a speaker, which is too poor to be practicable in characteristic according to the common concept of having a peak of a high level at the fundamental resonance frequency, and a speaker having an ordinary low range characteristic, it was first discovered that a total and flat frequency characteristic could be obtained. The reason that such a flat frequency characteristic is obtainable by satisfying the above conditions is discussed and explained below.

It is known from electric acoustic engineering that the speaker output sound pressure P at a low range frequency f is expressed in the following formula, supposing the output sound pressure at a frequency sufficiently higher (that is, a flat band) than the fundamental resonance frequency $f_1$ in the mass control band to be $P_0$:

$$P=P_0\times\{(f/f_1)/\{1Q_1^2+(f/f_1-f_1/f)^2\}^{0.5}\}$$

Herein, supposing $X=f/f_1$ (X is the normalization frequency, meaning the ratio to the fundamental resonance frequency), it follows that $$P=P_0\times\{X/\{1/Q_1^2+(X-1/X)_2\}^{0.5}\}$$

Meanwhile, generally, when the output sound level of each speaker is attenuated by several dB from the flat portion at the crossover frequency, a flat characteristic is obtained. For example, if the phase is matched completely at the crossover frequency of each speaker, a flat characteristic is obtained when attenuated by about 6 dB each (the sound pressure is attenuated to half), or if the phase difference is 45°, it is obtained when attenuated by about 3 dB each (the power is attenuated to half).

In the speaker system of this embodiment, the attenuation characteristic slope of the output sound pressure level above the fundamental resonance frequency $f_1$ of the first speaker 1, and the attenuation characteristic slope of the output sound pressure level at the output sound pressure level in the low range of the second speaker 2 are not the same, and the phases are not matched (or inverted) completely near the crossover frequency. As a result of computer simulation analysis, the difference of both phases around the crossover frequency is found to be about 30° to about 45° in the polarity matched (or inverted) state of the first speaker and the second speaker.

Accordingly, a flat frequency characteristic can be obtained by attenuating the level of each speaker at the crossover frequency by about 4 to 5 dB. However, since the voice coil of the speaker unit may include an inductance or a high range attenuating means such as choke coil may be used together, the sound pressure level may be lowered somewhat also near the crossover frequency $f_{cr}$. Therefore, considering the theoretical characteristic of the speaker unit itself not containing voice coil inductance, it seems appropriate to attenuate the level by about 4 dB around the crossover frequency.

Supposing the output sound pressure (that is, the peak output sound pressure) at the fundamental resonance frequency $f_1$ of the first speaker to be $P_1$, it follows that $P_1=P_0\times Q_1$. By aligning the output sound pressure of the whole band range nearly at $P_1$, a flat frequency characteristic can be obtained in total, and therefore the crossover frequency may be set around the frequency where the level is lowered by about 4 dB from the peak output sound pressure level (where the sound pressure is about 0.63 times). That is, the crossover frequency may be set around the frequency where $P=P_1\times 0.63$.

Since $$P=P_1\times 0.63=P_0\times Q_1\times 0.63$$

$$P=P_0\times[X/\{1/Q_1^2+(X-1/X)^2\}^{0.5}]$$

the value of X satisfying the relation of $$[X/\{1/Q_1^2+(X-1/X)^2\}^{0.5}]=Q_1\times 0.63$$

should be determined.

Raising the power to the second on both sides of the above formula, $$Q_1^2\{1/Q_1^2+(X-1/X)^2\}^{0.5}]=2.5X^2$$

and summing up, we obtain $$(Q_1^2-2.5)X^2-(2\times Q_1^2-1)+Q_1^2/X^2=0$$

Multiplying both sides by $X^2$, we obtain $$(Q_1^2-2.5)X^4-(2\times Q_1^2-1)X^2+Q_1^2=0$$

Solving and simplifying it by using the theorem of quadratic equation (with $X^2$ as unknown), we obtain $$X^2=\{2\times Q_1^2+(6\times Q_1^2+1)^{0.5}\}/2/(Q_1^2-2.5)$$

Since $6\times Q_1^2$ is sufficiently larger than 1, approximating as $$(6\times Q_1^2+1)\cong 6\times Q_1^2$$

we obtain $$X^2=\{2\times Q_1^2-1+6^{0.5}\times Q_1)/2/(Q_1^2-2.5)$$

Furthermore, since $(2\times Q_1^2+6^{0.5}\times Q_1)$ is sufficiently larger than 1, approximating as $$(2\times Q_1^2-1+6^{0.5}\times Q_1)\cong(2\times Q_1^2+6^{0.5}Q_1)$$

we obtain $$X^2=(2\times Q_1^2+6^{0.5}\times Q_1^2)/2/(Q_1^2-2.5)=(Q_1^2+1.2\times Q_1)/(Q_1^2-2.5)$$

Therefore, $$X=\{(Q_1^2+1.2\times Q_1)/(Q_1^2-2.5)\}^{0.5}$$

is obtained. Since $X=f/f_1$ and f corresponds to the crossover frequency $f_{cr}$, it follows that $$f_{cr}=f_1\times\{(Q_1^2+1.2\times Q_1)/(Q_1^2-2.5)\}^{0.5}$$

so that a most flat frequency characteristic may be obtained when $f_{cr}$ is around this frequency.

Next, the allowable deviation coefficient k of the crossover frequency $f_{cr}$ is determined. Generally, to obtain a practical low range frequency characteristic having no particular problem for the hearing sensation, the frequency characteristic must be controlled within a deviation of ±3 dB.

When the deviation is largest, the following case may be considered. That is, if there is only peak at the level of the flat band, it must be controlled under 6 dB, or if there is only a dip at the level of the flat band, it must be controlled under 6 dB.

A peak of 6 dB occurs near the crossover frequency $f_{cr}$ when $f_{cr}=f_1$ and the sound pressure phases of the first and second speakers are completely matched. Therefore, by setting $f_{cr}>f_1$, the peak around $f_{cr}$ can be set under 6 dB.

If a dip of 6 dB occurs near $f_{cr}$, it is found by computer simulation and experiment that $f_{cr}$ is about $\{(Q_1/(Q_1-1.4)\}^{2.5}$ times. If the frequency characteristic is twisted from the level of flat band to plus and minus side, too, it was found by computer simulation that the deviation can be controlled within ±3 dB by satisfying the two conditions of $f_{cr}>f_1$ and $f_{cr}$ within $\{(Q_1/(Q_1-1.4)\}^{2.5}$ times.

Therefore, by defining as $$f_1\leqq f_{cr}\leqq f_1\times\{(Q_1^2+1.2\times Q_1)/(Q_1^2-2.5)\}^{0.5}\times k$$

$$1\leqq k\leqq\{(Q_1/(Q_1-1.4)\}^{2.5}$$

a frequency characteristic within a deviation of ±3 dB can be obtained. When the crossover frequency $f_{cr}$ is at the optimum value at about k=1, a particularly flat frequency characteristic may be obtained.

Incidentally, in the range of $1.4\leqq Q_1\leqq 2.5^{0.5}(=1.58)$, the right side denominator $(Q_1^2-2.5)$ of the conditional formula of $f_{cr}$ is negative, and the right side becomes an imaginary number, but at this time the right side condition is invalid, and it is enough to satisfy the condition of $f_1\leqq f_{cr}$ alone. In other words, unless $Q_1$ is extremely large, if the crossover frequency is somewhat large, a large dip does not occur on the frequency characteristic.

In the speaker system of the invention, by satisfying the condition of the crossover frequency mentioned above, a flat frequency characteristic is realized in the whole band range, and although the total inner volume is only 2.7 liters, the low range reproduction limit frequency of as low as about 55 Hz/−3 dB, and the output sound pressure level of as high as about 82 dB are realized. This value is higher than the conventional limit by about 3 dB. In the embodiment, still more, being k=1.1, it is close to the optimum condition of k=1, and therefore, as known from FIG. 2, an extremely flat frequency characteristic with sound pressure level deviation of less than ±1 dB is obtained.

In the speaker system of the embodiment, since the first speaker 1 is a closed type, the diaphragm amplitude does not become excessive even below anti-resonance frequency, as experienced in the conventional bass reflex type speaker system, and it is possible to withstand if a large input is applied in the bass range. In the conventional bass reflex type speaker system, below the anti- resonance frequency, the sound pressure of the speaker unit and the sound pressure of the port cancel each other and the ultra-bass range is suddenly attenuated, but such phenomenon does not occur in the speaker system of the embodiment, and an excellent bass sound can be obtained.

In the conventional speaker system, a large BL value was needed in order to obtain a flat frequency characteristic at as far as 55 Hz in the same inner volume and speaker unit aperture, and a very large magnet of about 110 mm in outer diameter was required. In the embodiment, on the other hand, in the first speaker 1, the BL of the first speaker unit 1b may be a small value in order to heighten the Q of the low range resonance, and the magnet size may be as small as 60 mm in outer diameter.

Thus, according to the embodiment, since the resonance sharpness of the first speaker 1 is very high, the output sound pressure level of the bass range can be substantially heightened. It is not necessary to lower the fundamental resonance frequency $f_2$ of the second speaker 2, and the output sound pressure level of the medium and treble range can be easily heightened, and a high efficiency is established in both bass range and medium and treble range. (It is because $f_2$ is required to be considerably high in order to satisfy both condition of $f_1<f_2$ and condition of crossover frequency $f_{cr}$)

Since the crossover frequency is set in the optimum condition, a flat frequency characteristic is obtained in the whole band range including the vicinity of crossover frequency.

Meanwhile, since the second speaker 2 is not required to reproduce the bass range, and the effective vibration radius (aperture) of the second speaker unit 2b may be small, and the inner volume of the second cavity 2a may be small. Hence, the total inner volume is not increased notably.

Therefore, a flat frequency characteristic is obtained in the whole band range at a high output sound pressure level in a specific inner volume, and the low range reproduction capacity can be heightened further from the conventional limit.

In the first speaker 1, to heighten the Q of low range resonance, the BL of the first speaker unit 1b may be a small value, and the magnet size can be reduced extremely. Hence, the cost may be lowered.

In the embodiment, in both the first speaker 1 and the second speaker 2, one speaker unit is used. However, a plurality of speaker units may be used individually.

Also in the embodiment, the first speaker 1 is of closed type, but it may be a bass reflex type of a sufficiently low anti- resonance frequency as compared with the fundamental resonance frequency $f_1$. Or, a Kelton type speaker may be used.

In the case of a large external size appliance, such as a large-screen television, as mentioned later in a fourth exemplary embodiment, a rear open type may be employed. In this case, the fundamental resonance frequency $f_1$ and resonance sharpness $Q_1$ of the first speaker 1 are nearly same as the values of the first speaker unit 1b itself, and it may be designed to heighten the resonance sharpness of the speaker unit 1b itself.

In the embodiment, the second speaker 2 is of closed type, but it may be also of bass reflex type. In this case, when the anti-resonance frequency is designed to be lower than the crossover frequency $f_{cr}$, being close to the fundamental resonance frequency of the first speaker, the diaphragm amplitude in the bass range of the second speaker unit 2b decreases, so that the distortion can be reduced.

Further, in the case of a large external size such as a large-screen television, as mentioned later in the fourth exemplary embodiment, a rear open type may be employed. In this case, the fundamental resonance frequency $f_2$ of the second speaker 2 is nearly same as the value of the second speaker unit 2b itself.

In the embodiment, the first speaker 1 and second speaker 2 are driven by individual power amplifiers 8, 9, but as far as the load impedance of the power amplifier unit permits, both speakers may be connected parallel and driven by one power amplifier.

The input sensitivity of the power amplifiers 8, 9 is the same, but if the sensitivity is different between two speaker units, the input sensitivity may be changed in order to correct it.

It may be also possible to compose a so-called 3D system by combining one first speaker driven by a synthesized low range signal from stereo L and R channels, and one second speaker for each channel (two in total). If the number of channels is three or more, as mentioned later in the fourth exemplary embodiment, it is possible to compose a system by combining one first speaker with as many second speakers as the number of channels.

In this embodiment, incidentally, the polarity of the first speaker 1 and second speaker 2 is opposite, but, for example, if the first speaker 1 and the second speaker 2 are installed across a long distance and the phase is turned around the crossover frequency $f_{cr}$, the both speakers should be of the same polarity in order to obtain a flat characteristic.

Also in the embodiment, the voice coil inductance of the first speaker unit 1b itself is increased in order to attenuate the high range, in particular, but if fluctuations of high range characteristic of the speaker unit are small, any particular means for attenuating the high range is not necessary. This is because the Q of low range resonance of the first speaker 1 is high, and therefore the sound pressure level of the medium and high range of the first speaker 1 is much lower than the level of this low range resonance, that is, the level of the flat portion of the whole band range as the speaker system.

Or, to attenuate the high range, a choke coil or a high cut filter of a net shaped structure such as a punching net or lattice net covered in front of the speaker may be used, or the speaker unit may be equipped with a mechanical high cut filter. Without attenuating the high range at the speaker side, of course, the high range signal may be attenuated by an amplifier or equalizer.

In the embodiment, the low range signal of the second speaker 2 is not particularly attenuated, but the low range signal may be also attenuated by the speaker network or by an amplifier or equalizer.

As described herein, according to the first exemplary embodiment of the invention, since the resonance sharpness of the first speaker is extremely high, the output sound pressure level in the bass range can be substantially heightened. Moreover, it is not necessary to lower the fundamental resonance frequency of the second speaker, so that the output sound pressure level in the medium and treble range can be easily heightened. Since the crossover frequency is set in the optimum condition as described specifically above, a flat frequency characteristic can be obtained at a high output sound pressure level in the whole band range, and the low range reproduction capacity can be further heightened from the conventional limit. In the first speaker, since the Q of the low range resonance is high, the BL of the first speaker unit may be a small value, and the magnet size can be extremely reduced, and thereby the cost can be lowered.

Second exemplary embodiment

Figure 3:
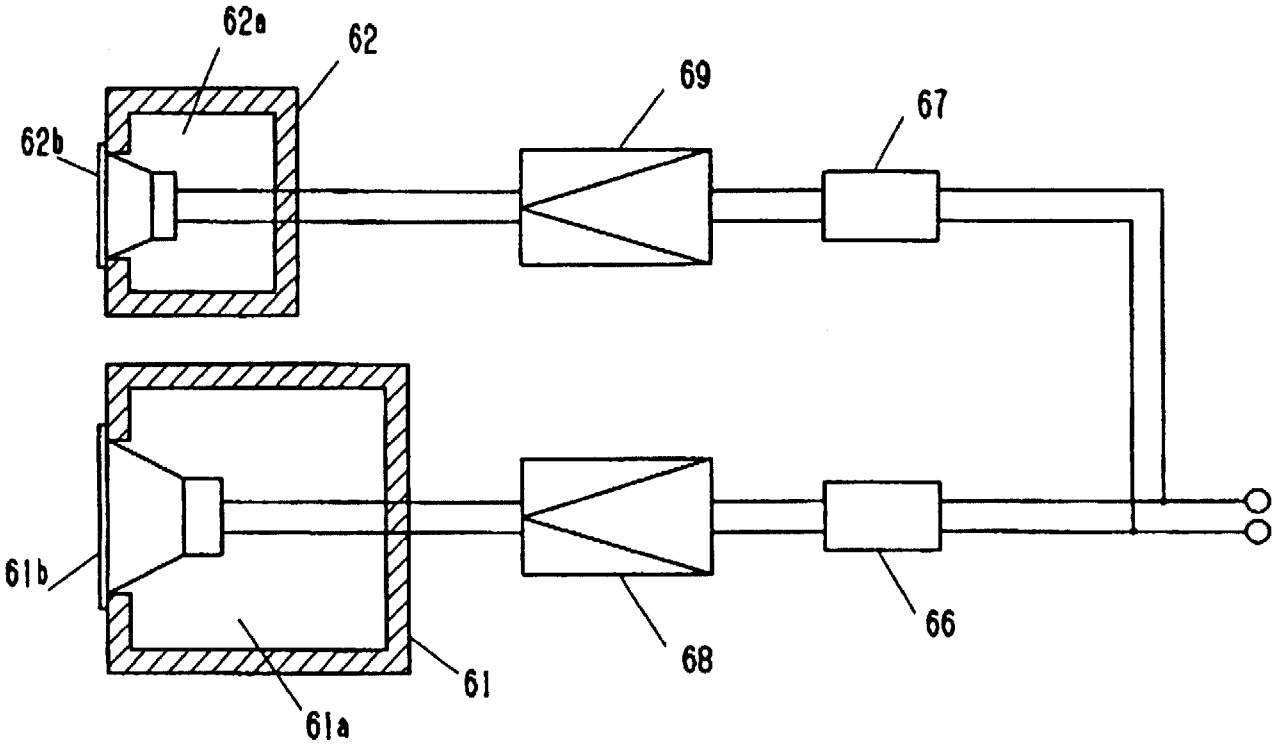
FIG. 3 is a block diagram of a speaker system in a second embodiment of the invention.

FIG. 3 is a block diagram of a speaker system in a second exemplary embodiment of the invention. In FIG. 3, a first speaker 61 measures 15 cm in width, 15 cm in height, 14 cm in depth, and 10 mm in thickness. A first cavity 61a is a closed type with an inner volume of 2.0 liters.

A first speaker unit 61b is a woofer with an aperture of 14 cm. Its impedance is 6Ω. The magnet measures 60 mm in outer diameter, 32 mm in inner diameter, and 9 mm in thickness. The BL is 4.3. The effective vibration radius is 47 mm. The effective vibration mass is 28 g. The independent fundamental resonance frequency is 30 Hz. The mechanical resonance sharpness (Qm) is 8.0, and the voice coil DC resistance is 4.8Ω. The voice coil is an eight-layer winding type of 25 mm in diameter, and its inductance is very large. The sound pressure level in the treble range is attenuated.

The first speaker unit 61b is contained in the first cavity 61a to form the first speaker 61. The fundamental resonance frequency $f_1$ of the first speaker 61 is 62 Hz, and the resonance sharpness $Q_1$, is 2.1.

A second speaker 62 measures 9 cm in width, 13 cm in height, 11.5 cm in depth, and 10 mm in thickness. A second cavity 62a is a closed type with an inner volume of 0.5 liters.

A second speaker unit 62b is a full range speaker with an aperture of 7 cm. Its impedance is 4Ω. The output sound pressure level is 80.5 dB/1 W, and a sound pressure level of 82 dB is obtained by 1 W input at the impedance of 6 Ω.

The second speaker unit 62b is contained in the second cavity 62a to form the second speaker 62, and the fundamental resonance frequency $f_{fr}$ of the second speaker 62 is about 150 Hz. So far it is same as the description in the first exemplary embodiment.

Figure 4:
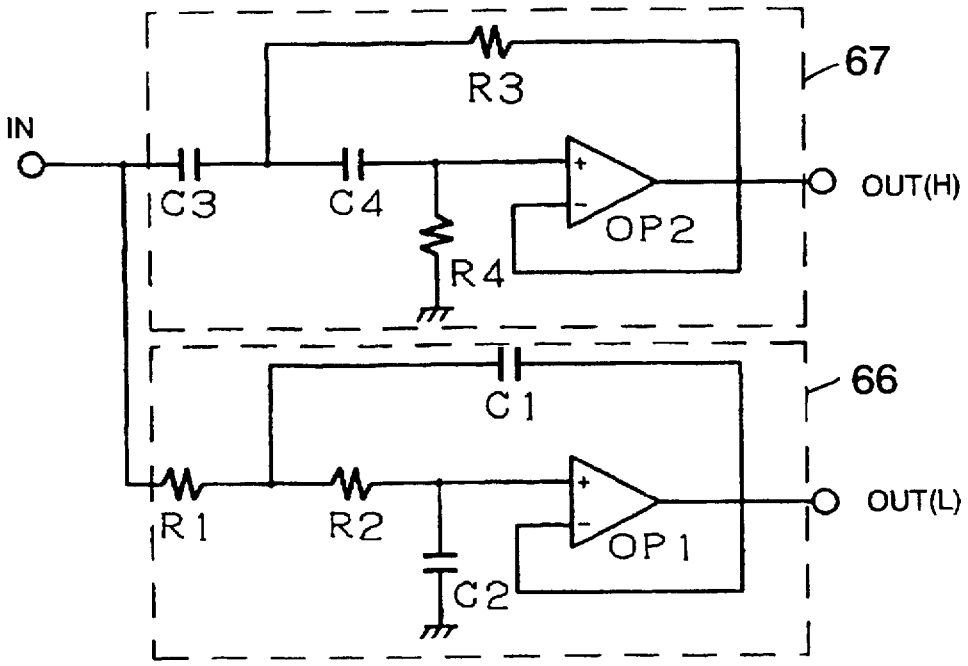
FIG. 4 is a block diagram of each electric circuit filter in the second embodiment in FIG. 3.

In this embodiment, the first speaker 61 and second speaker 62 are driven together by individual power amplifiers 68, 69 having electric circuit filters 66, 67 in the front stage (bi-amplifier system). An example of the electric circuit of the filters 66, 67 is shown in FIG. 4. One is a low pass filter circuit 66 composed of resistances R1, R2 of 10kΩ, a capacitor C1 with a capacity of 0.22 μF, a capacitor C2 a with capacity of 0.056 μF, and an operational amplifier OP1. The other is a high pass filter 67 composed of a resistance R3 of 5.6 kΩ, a resistance R4 of 10 kΩ, capacitors C3, C4 with a capacity of 0.22 μF, and an operational amplifier OP2. An output terminal OUT(L) of the low pass filter circuit 66 is connected to the power amplifier 68, and an output terminal OUT(H) of the high pass filter circuit 67 to the power amplifier 69. In this constitution, the resonance frequency $f_2$ of the low pass filter 67 is 140 Hz, and the resonance sharpness $Q_2$ is 1.3. In this embodiment, the bass range signal is attenuated by installing the high pass filter circuit 67 in the second speaker 62; but it is not always necessary. The frequency characteristic of the power amplifiers 68, 69 is flat, the input sensitivity and maximum output electric power are same, and acoustically, it is exactly the same as when the two speakers are connected in parallel and driven by one power amplifier. In this embodiment, the polarity of the first speaker 61 and second speaker 62 is opposite. The crossover frequency $f_{cr}$ of the first speaker 61 and second speaker 62 is set at about 150 Hz.

Figure 5:
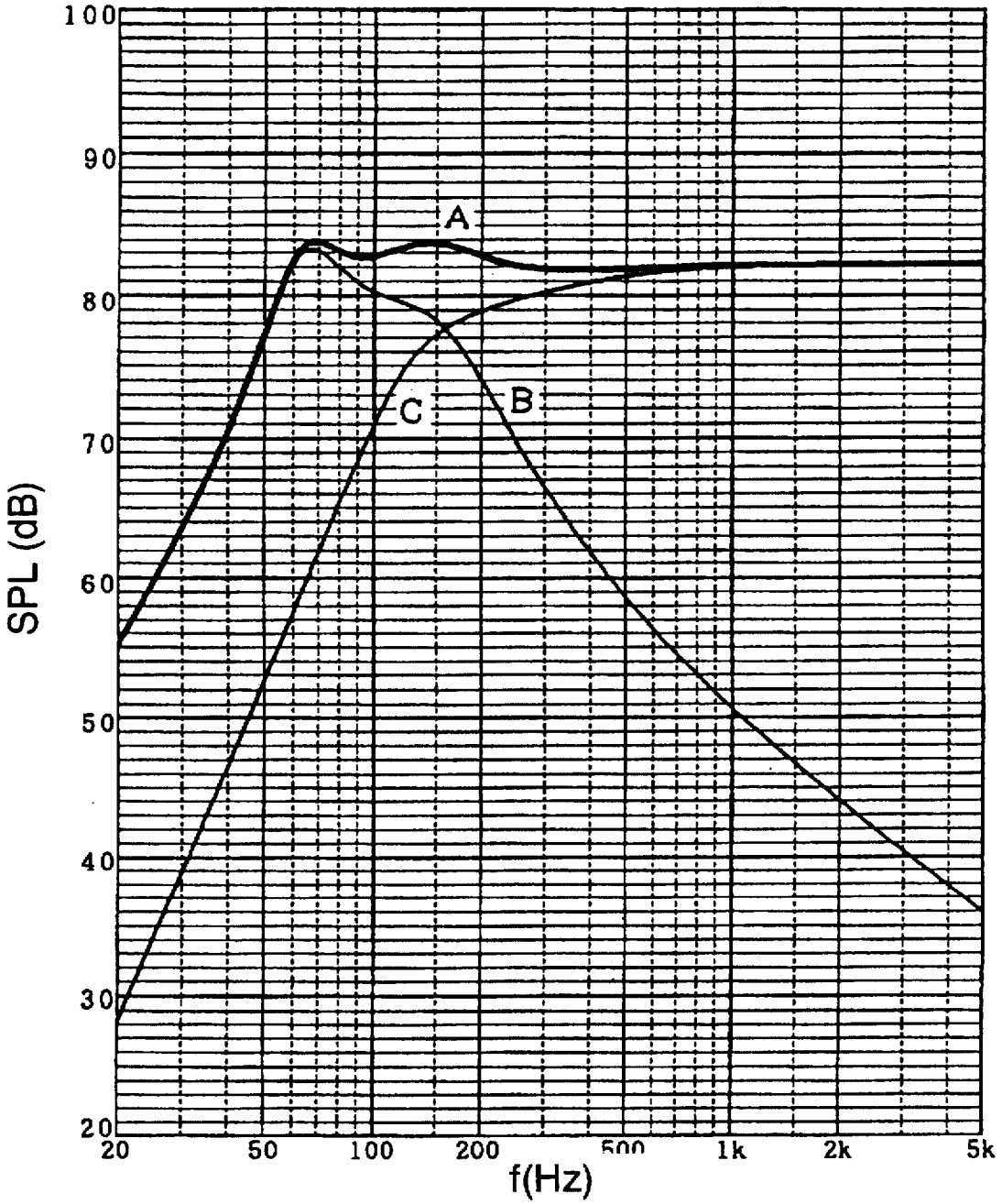
FIG. 5 is a frequency characteristic diagram of the speaker system in the second embodiment.

In the speaker system of the embodiment thus constituted, its action and effect are described below while referring to FIG. 5. FIG. 5 is a frequency characteristic diagram of this embodiment.

In FIG. 5, B is the sound pressure frequency characteristic of the first speaker 61, C is the sound pressure frequency characteristic of the second speaker 62, A is the total sound pressure frequency characteristic of the two speakers, and the input voltage is equivalent to 1 W at an impedance of 6Ω. These characteristics are provided with infinite baffle.

Since the resonance sharpness $Q_1$ of the first speaker 61 is as high as 2.1, a high output sound pressure level of about 83 dB can be obtained near the fundamental resonance frequency $f_1$, of 62 Hz, as indicated by B.

As for the value of Q2, 0.7 or more is required so that dip may not appear in the frequency characteristic at the crossover with the second speaker, but if extremely large, a peak appears in the frequency characteristic as clarified from simulation analysis and experiment. Hence, the upper limit is set around 5.

Since the embodiment is set to satisfy the condition of $$1.4 \leqq Q_1 \leqq 10$$

$$0.7 \leqq Q_2 \leqq 5$$

$$f_1 < f_2$$

by the low pass filter circuit 67 provided in the first speaker 61, a sound pressure elevation occurs near 140 Hz of its resonance frequency $f_2$, and a sound pressure elevation of about 3 dB is obtained as compared with a speaker system without a low pass filter circuit.

On the other hand, in the speaker 61 of the embodiment, since the reproduction band range can be expanded to 140 Hz or more as compared with the first speaker 1 in the first exemplary embodiment, it is not necessary to lower the fundamental resonance frequency $f_{fr}$ of the second speaker 62. The output sound pressure level can be easily heightened, and the crossover frequency $f_{cr}$ of the first speaker 61 and second speaker 62 can be set at about 150 Hz. In the speaker system of the first exemplary embodiment, a flat characteristic could not be attained unless the crossover frequency $f_{cr}$ was set around 120 Hz.

In the embodiment, in both the first speaker 61 and the second speaker 62, one speaker unit is used. However, a plurality of speaker units may be used individually.

In this embodiment, the second speaker 62 is of closed type. However, it may be also a bass reflex type. In this case, when the anti-resonance frequency is designed to be lower than the crossover frequency $f_{cr}$, being close to the fundamental resonance frequency $f_1$ of the first speaker 61, the diaphragm amplitude in the bass range of the second speaker unit 62 decreases, so that the distortion can be reduced.

It may be also possible to compose a so-called 3D system by combining one first speaker driven by a synthesized low range signal from stereo L and R channels, and one second speaker for each channel (two in total). If the number of channels is three or more, it is possible to compose a system by combining one first speaker with as mane second speakers as the number of channels.

In this embodiment, the polarity of the first speaker 61 and second speaker 62 is opposite, but, for example, if the first speaker 61 and the second speaker 62 are installed across a long distance and the phase is turned around the crossover frequency $f_{cr}$, both speakers should be of the same polarity in order to obtain a flat characteristic.

Also in the embodiment, the low pass filter circuit 66 and high pass filter circuit 67 are composed of resistances, capacitors and an operational amplifier, but this composition is not limited.

As described herein, according to the second exemplary embodiment of the invention, the effects are exactly the same as in the first exemplary embodiment. Since the crossover frequency can be set higher, it is not necessary to lower the fundamental resonance frequency of the second speaker, and therefore, the diaphragm amplitude in the bass range of the second speaker unit 62 decreases, and the distortion can be reduced.

Third exemplary embodiment

Figure 6:
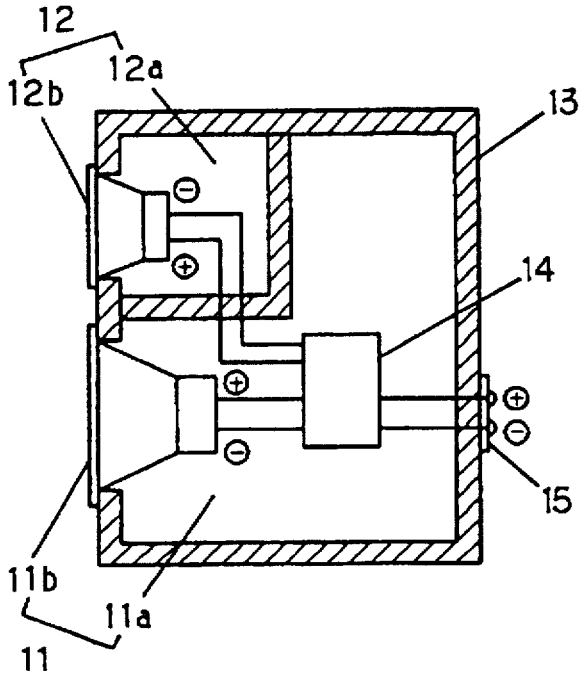
FIG. 6 is a block diagram of a speaker system in a third embodiment of the invention.

FIG. 6 is a block diagram of a speaker system according to a third exemplary embodiment of the invention. In FIG. 6, a first cavity 11a is of a closed type with an inner volume of 1 liter. A first speaker unit 11b is a woofer with an aperture of 10 cm.

Its impedance is 4Ω. The magnet is small, measuring 55 mm in outer diameter, 26 mm in inner diameter, and 9 mm in thickness. The BL is 3.0. The effective vibration radius is 40 mm. The effective vibration mass is 22 g. The independent fundamental resonance frequency is 27 Hz. The mechanical resonance sharpness is 10, and the voice coil is of six-layer winding type 19 mm in diameter, with a voice coil DC resistance is 3.2Ω.

The first speaker unit 11b is contained in the first cavity 11a to form a first speaker 11. The fundamental resonance frequency $f_1$ of the first speaker 11 is 69 Hz, and the resonance sharpness $Q_1$ is 2.5.

A second cavity 12a is a closed type with an inner volume of 0.3 liter. A second speaker unit 12b is full range with an aperture of 6.5 cm.

Its magnet size is same as in the first speaker unit 11b, measuring 55 mm in outer diameter, 26 mm in inner diameter and 9 mm in thickness. Its BL is 4.7. The effective vibration radius is 25 mm. The effective vibration mass is 1.8 g. The independent fundamental resonance frequency is 80 Hz, and the output sound pressure level is 85 dB/W (80 dB in the case of 1 W input at 4Ω). The mechanical resonance sharpness is 5.0, and the voice coil is a two-layer winding type of 19 mm in diameter.

The second speaker unit 12b is contained in the second cavity 12a to form a second speaker 12, and the fundamental resonance frequency $f_2$ of the second speaker 12 is 175 Hz.

The crossover frequency $f_{cr}$ of the first speaker 11 and the second speaker 12 is set at 135 Hz (k=1.25), so as to satisfy the condition explained in the first exemplary embodiment. So far it is same as the description in the first exemplary embodiment.

In this embodiment, the first speaker 11 and the second speaker 12 are integrated in a cabinet 13. The cabinet 13 is small, measuring 14 cm in width, 20 cm in height, 9 cm in depth, and 10 mm in thickness.

Figure 7:
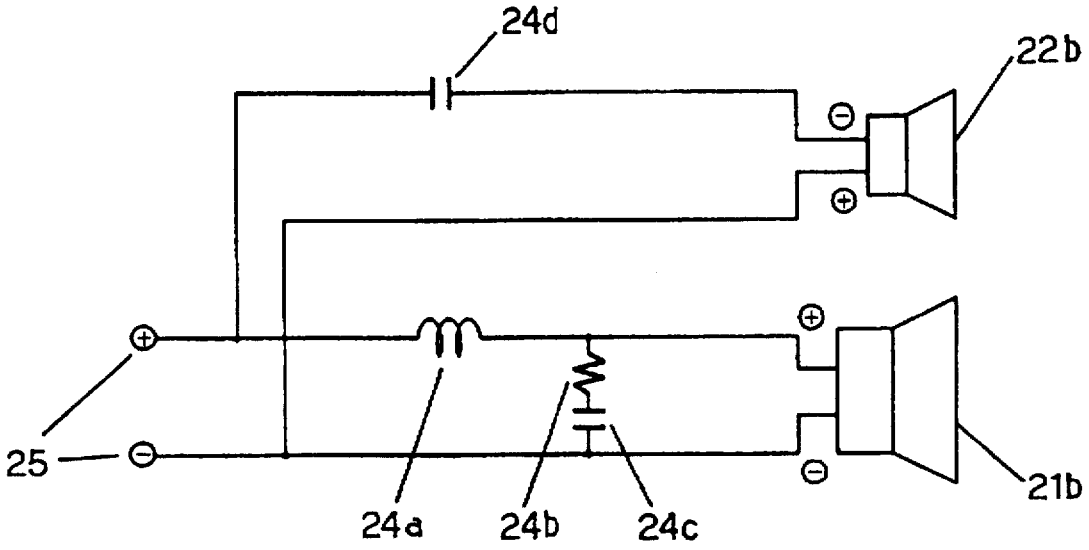
FIG. 7 is a network circuit diagram of the speaker system in the third embodiment.

The embodiment comprises a network circuit 14 connected to an input terminal 15, a low range signal attenuating means for the second speaker 12, and a high range signal attenuating means for the first speaker 11. The detail is shown in FIG. 7. FIG. 7 is a network circuit diagram of the speaker system of the embodiment.

In FIG. 7, the capacity of a capacitor 24d, as the low range signal attenuating means, is 150 μF. The inductance of a choke coil 24a, as a high range signal attenuating means, is 1 mH. The capacity of a capacitor 24c is 33 μF, and a resistance of the resistor 24b is 3.3Ω.

In the embodiment, the impedance of the second speaker unit 12b is 12Ω, and the DC resistance (lowest impedance) is 10Ω, which is larger than the DC resistance of the first speaker unit 11b. In this embodiment, as shown in FIG. 7, the first speaker unit 21b and second speaker unit 22b are connected parallel in reverse phase.

In the speaker system of the embodiment thus described, the basic action and effect are exactly the same as in the first exemplary embodiment.

Figure 8:
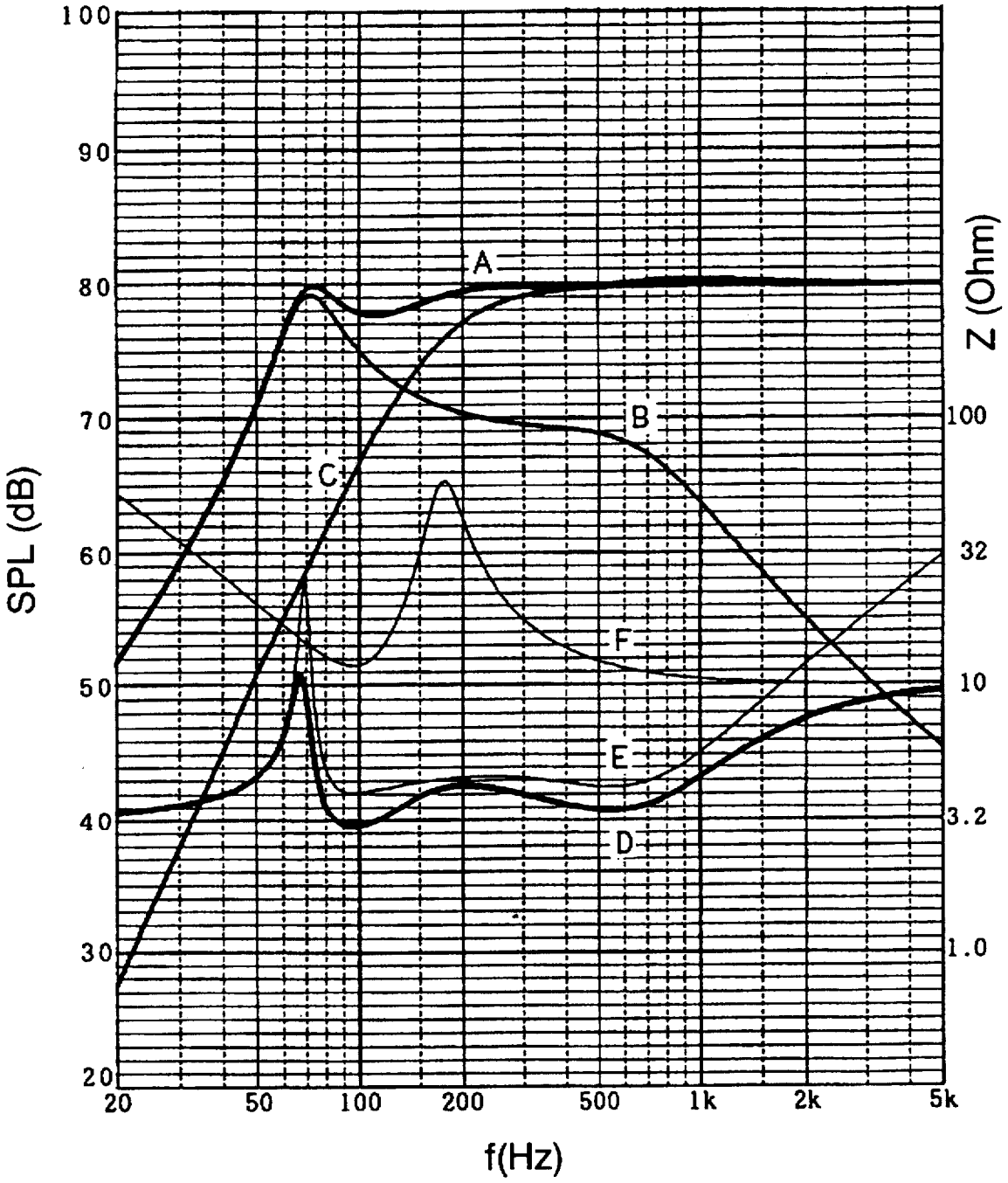
FIG. 8 is a frequency characteristic diagram of the speaker system in the third embodiment.

More specifically, FIG. 8 is a frequency characteristic diagram obtained by simulation of the speaker of the embodiment with infinite baffle. The input voltage is equivalent to 1 W at an impedance of 4Ω. As indicated by A herein, in spite of the total inner volume of only 1.3 liters, a low range reproduction limit frequency of as low as about 60 Hz is obtained. Also, an output sound pressure level of 80 dB is obtained at the same time. (The limit was about 76 dB in the conventional speaker system.) A nearly flat frequency characteristic within a deviation of ±1.5 dB is obtained.

The cost is much lower than the conventional speaker system. In particular, as compared with the total magnet weight of a woofer and tweeter required in the conventional speaker system, the total magnet weight of the speaker unit using a woofer and a full range speaker in this embodiment is much smaller.

Further, the third embodiment comprises a network circuit 14 having a low range signal attenuating means for the second speaker 12. Also, the lowest impedance of the second speaker 12 is higher than the DC resistance of the first speaker 11, and therefore, the impedance of the second speaker 12 is not lowered too much.

In FIG. 8, E denotes the characteristic of impedance Z of the first speaker 11, F is the characteristic of impedance Z of the second speaker 12, and D shows the characteristic of their total impedance Z. Since the impedance of the second speaker 22 is high, the total impedance Z is not lowered too much as indicated by D in FIG. 8. Specifically, an excessive load is not applied to the amplifier due to an excessive decline of impedance.

Moreover, since the first speaker 11 and the second speaker 12 are integrated, the size is smaller than in the first and second exemplary embodiments. Therefore, this embodiment has the advantage of providing a speaker system that is usable alone, is high in its low range reproduction capacity without an excessive load to the amplifier, is low in S cost, is very practical, and is high in performance.

Incidentally, the polarity of the second speaker 12 is opposite to that of the first speaker 11. In particular, it is necessary to connect the speakers in reverse phase because the phase of the second speaker 12 is advanced as the low range is attenuated and the phase difference of the two speakers becomes nearly 180° around the crossover frequency $f_{cr}$.

In the third embodiment, the high range of the first speaker 11 is attenuated by the network circuit 14, but it is not always necessary when. For example, the high range is attenuated in the speaker unit 11b itself.

In this embodiment, the impedance of the second speaker 12 is 12Ω. However, it does not matter if the impedance of the second speaker unit 12b is lower than the DC resistance of the first speaker 11 as far as the impedance as seen from the terminal 15 is higher than the DC resistance of the first speaker 11 when, for example, a resistance is connected in series to the network circuit 14.

The embodiment relates to a two-way composition of a woofer and a full range speaker. However, it may be also realized in a three-way composition by adding a tweeter, using the full range speaker in the mid-range.

Thus, the effects of the third exemplary embodiment are exactly the same as in the first exemplary embodiment. Moreover, the network circuit having low range signal attenuating means for the second speaker is provided, the lowest impedance of the second speaker is set higher than the DC resistance of the first speaker, and the first speaker and second speaker are integrated. Therefore, the first speaker and second speaker can be used in an integral form without applying an excessive load to the amplifier, and the speaker system is smaller, has a higher low range reproduction capacity, is lower in cost, and a higher usefulness and higher performance can be realized.

Fourth exemplary embodiment

Figure 9:
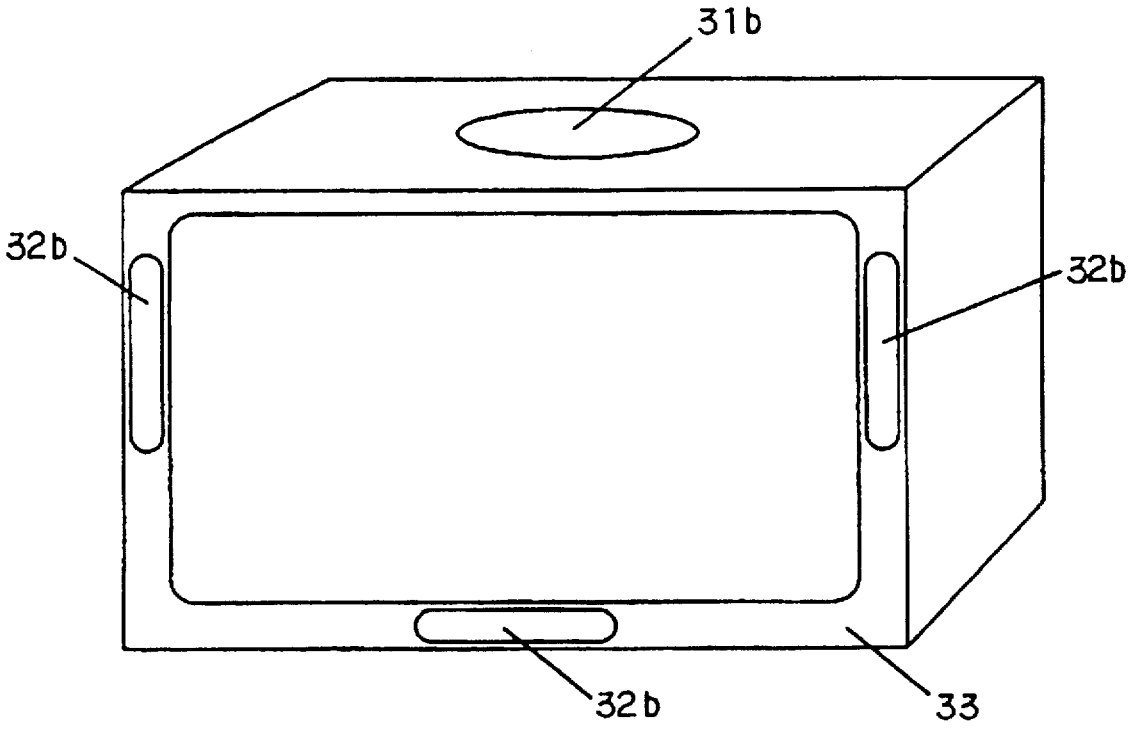
FIG. 9 is a block diagram of a speaker system in a fourth embodiment of the invention.

FIG. 9 is a block diagram of a speaker system according to a fourth exemplary embodiment of the invention. A 32-inch television cabinet 33 is a rear open type. In this embodiment, one first speaker unit 31b is installed in the ceiling or top of the cabinet 33. Three second speaker units 32*b* for three channels are installed in the right, left and lower positions of the front side of the cabinet 33. Thus, the first speaker unit 31*b* and second speaker units 32*b* share the same cabinet 33.

The first speaker unit 31*b* is a woofer with an aperture of 12 cm. The magnet size is 45 mm in outer diameter, 22 mm in inner diameter, and 8 mm in thickness, and it is provided with a magnetism-proof cover. The independent fundamental resonance frequency of the speaker unit 31*b* is 100 Hz, and the resonance sharpness is 3.0. The second speaker units 32*b* are full range speakers of oval shape, measuring 3 cm by 12 cm, and, having an internal magnetic field system of Alnico (trademark) magnet. The independent fundamental resonance frequency is 180 Hz.

The crossover frequency of the first speaker unit 31*b* and second speaker units 32*b* is about 180 Hz, which satisfies the condition explained in the first exemplary embodiment. Each speaker is driven by individual power amplifiers (four in total); same as in the first exemplary embodiment.

Since the cabinet 33 is a rear open type cabinet, the fundamental resonance frequency of the first and second speakers 31*b*, 32*b* is hardly raised, and the resonance sharpness is almost unchanged.

In the speaker system of the embodiment thus constituted, the basic action and effect are exactly the same as in the first exemplary embodiment.

Moreover, in this embodiment, since the cabinet (cavity) is shared by the first speaker unit and second speaker units, the mounting and wiring are easy, and the manufacture can be simplified.

In the embodiment, all speaker units are driven by individual power amplifiers, but, for example, it is also possible to use the speaker system as mentioned in the third exemplary embodiment by using one power amplifier for each channel of two-channel television voice signal, and coupling the first speaker 31*b* and second speakers 32*b* by network.

In the embodiment, the cavity is a rear open type, but it may be also a closed type or the like. In this case, by increasing the support system stiffness of the second speaker units 32*b*, it may be designed to lessen the vibration of the diaphragm of the second speaker units 32*b* by the sound pressure in the cavity generated by the first speaker unit 31*b*.

Thus, the effects of the invention are exactly the same as in the first exemplary embodiment, and in addition, by sharing the cabinet (cavity) by the first speaker unit 31*b* and second speaker units 32*b*, the structure is simplified and manufacturing can be facilitated.

Fifth exemplary embodiment

Figure 10:
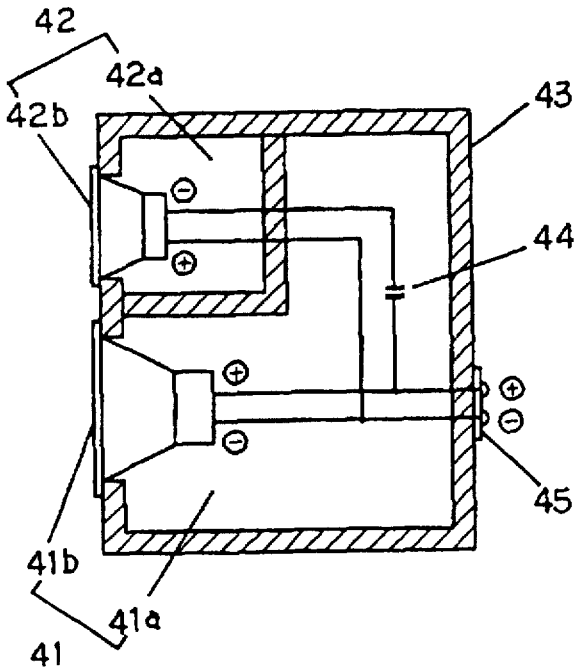
FIG. 10 is a block diagram of a speaker system in a fifth embodiment of the invention.

FIG. 10 is a block diagram of a speaker system of a fifth exemplary embodiment. A first speaker 41 has a woofer type first speaker unit 41*b* with an aperture of 17 cm contained in a first cavity 41*a* with an inner volume of 7.0 liters.

A second speaker 42 has a woofer type second speaker unit 42*b* with an aperture of 12 cm contained in a second cavity 42*a* with an inner volume of 1.0 liter. The first speaker 41 and second speaker 42 are integrated in a cabinet 43. The cabinet 43 measures 22 cm in width, 37 cm in height, 14 cm in depth, and 10 mm in thickness.

In the first speaker unit 41*b*, the magnet size is 65 mm in outer diameter, 32 mm in inner diameter, and 10 mm in thickness. The BL is 5.1. The effective vibration radius is 65 mm. The effective vibration mass is 16 g. The independent fundamental resonance frequency is 45 Hz. The mechanical resonance sharpness is 10. The voice coil is a four-layer winding type of 25 mm in diameter with a voice coil DC resistance of 6.0Ω.

In the second speaker unit 42*b*, the magnet size is 60 mm in outer diameter, 32 mm in inner diameter, and 9 mm in thickness. The BL is 5.0. The effective vibration radius is 45 mm. The effective vibration mass is 8 g. The independent fundamental resonance frequency is 65 Hz. The mechanical resonance sharpness is 4. The voice coil is a four-layer winding type of 25 mm in diameter with a voice coil DC resistance of 7.2Ω.

The impedance of the first speaker 41 is 6Ω. The fundamental resonance frequency $f_1$ is 86 Hz, and the resonance sharpness $Q_1$ is 1.7. The impedance of the second speaker 42 is 8Ω. The fundamental resonance frequency $f_2$ is 155 Hz, and the resonance sharpness $Q_2$ is 1.35. This satisfies the impedance condition mentioned in the second exemplary embodiment. The crossover frequency of both speakers is 190 Hz, which satisfies the condition mentioned in the first exemplary embodiment.

When a voltage of 2.83 V is applied to an input terminal 45, the output sound pressure level $L_1$ of the first speaker is about 85 dB, and the output sound pressure level $L_2$ of the second speaker is about 84 dB.

At the input side of the second speaker 42, a capacitor 44 is connected in series as a low range signal attenuating means, and its capacity is 120 μF. The first speaker 41 and second speaker 42 are connected in parallel in reverse phase to the input terminal 45.

In the speaker system of the embodiment thus constituted, the basic action and effect are exactly the same as in the combined form of the first and third exemplary embodiments. Specifically, in spite of the total inner volume of 8 liters, a high efficiency of 91 dB is realized at the low range limit frequency of 75 Hz, as indicated by frequency characteristic A in FIG. 11, and a reduction of cost is also realized.

Figure 11:
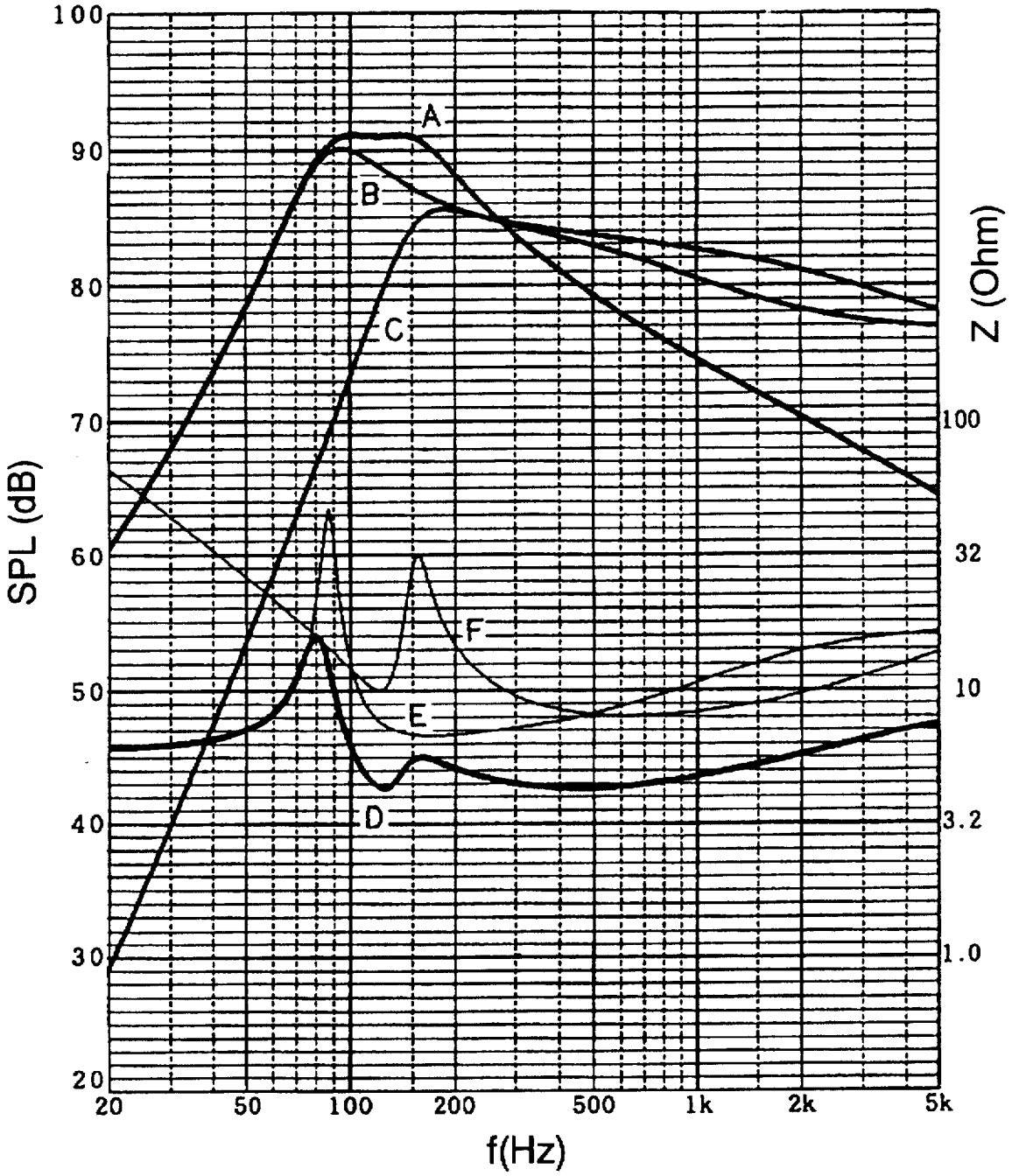
FIG. 11 is a frequency characteristic diagram of the speaker system in the fifth embodiment.
Figure 12:
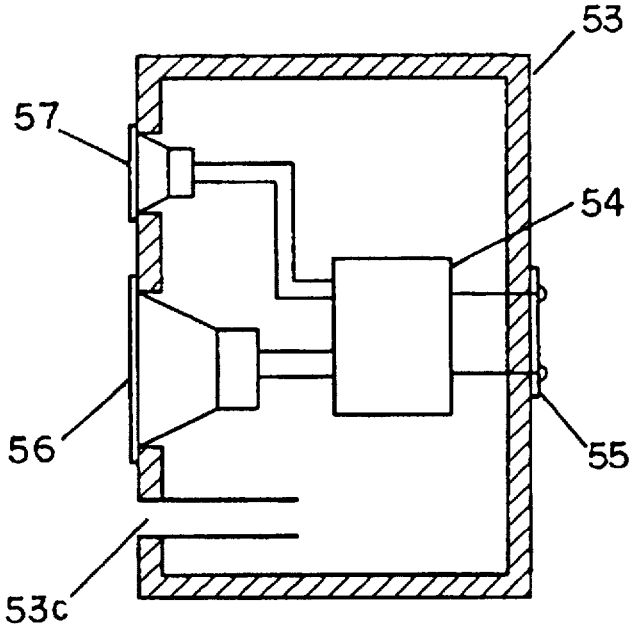
FIG. 12 PRIOR ART
FIG. 12 is a block diagram of a conventional bass reflex type speaker system.
Figure 13:
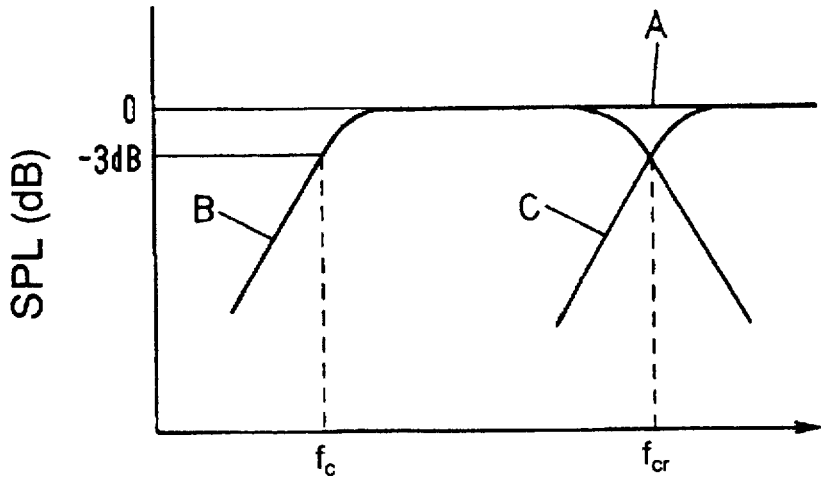
FIG. 13 PRIOR ART
FIG. 13 is a frequency characteristic diagram of the conventional bass reflex type speaker system.
Figure 14:
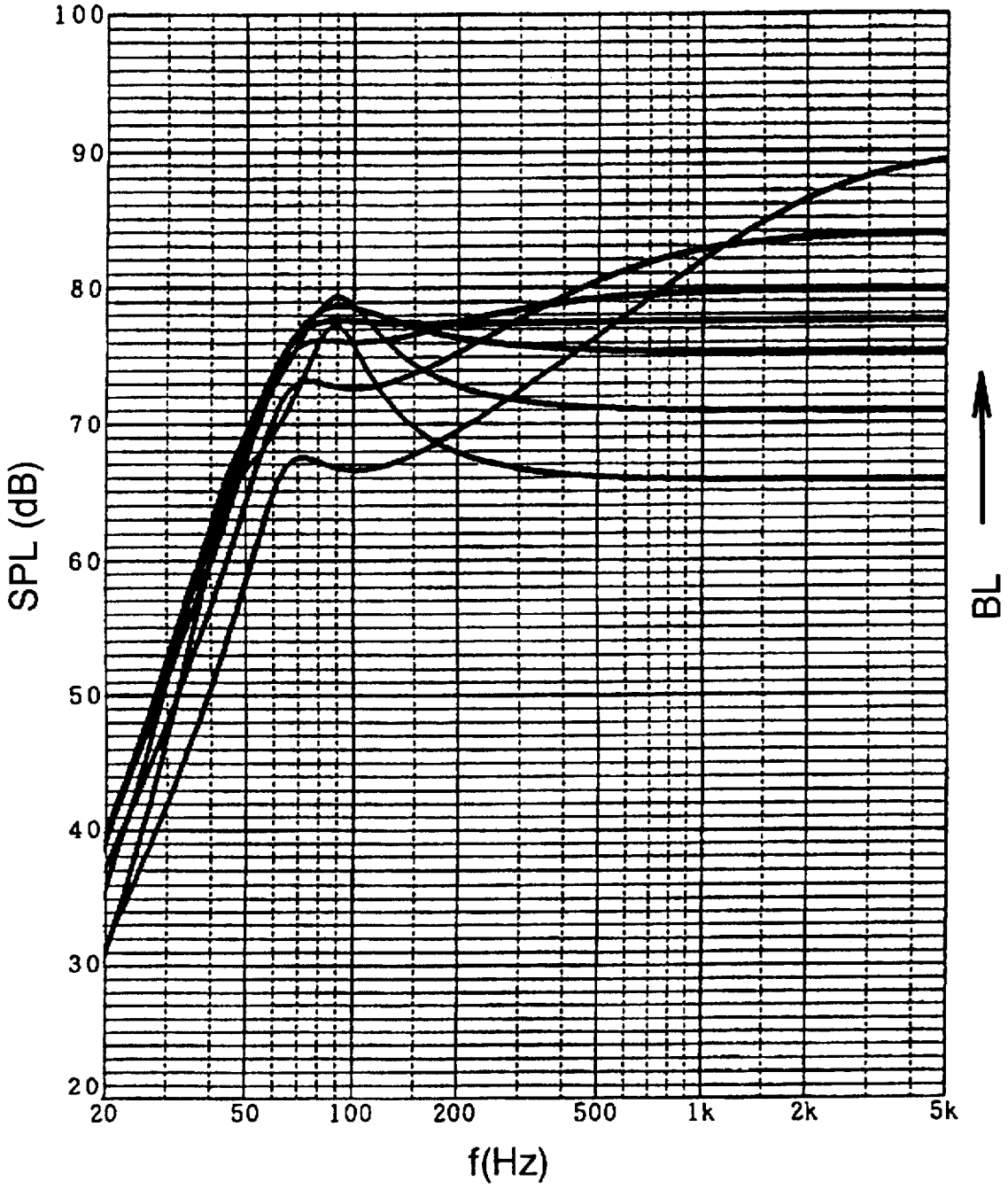
FIG. 14 PRIOR ART
FIG. 14 is a frequency characteristic diagram by varying the BL of the conventional bass reflex type speaker system.
Figure 15:
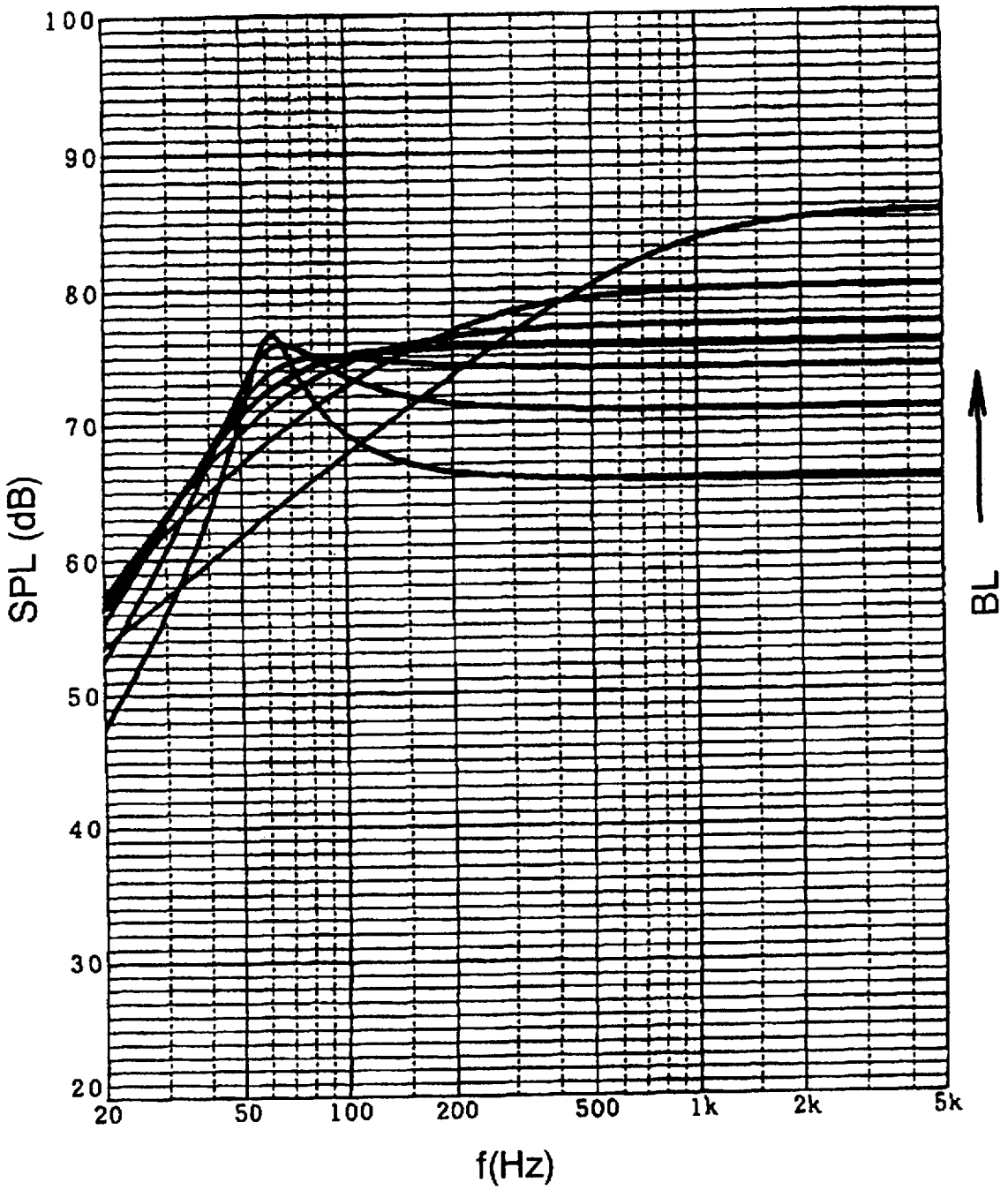
FIG. 15 PRIOR ART
FIG. 15 is a frequency characteristic diagram by varying the BL of the conventional closed type speaker system.

Further in this embodiment, since the value of $Q_2$ is a large value so as to satisfy the condition of $Q_1 \times 0.5 \leqq Q_2 \leqq Q_1$, as indicated by frequency characteristic B in FIG. 11, the second speaker 42 reaches the maximum sound pressure level near the fundamental resonance frequency $f_2$, and over the fundamental resonance frequency $f_2$ the sound pressure level tends to attenuate moderately.

Moreover, by satisfying the condition of $L_2 = L_1 \pm 5$ dB in the output sound pressure levels $L_1$, $L_2$ at the same input voltage of the speakers 41, 42, the output sound pressure levels of the both speakers 41, 42 are close to each other in the medium and treble range. Since the first speaker 41 and the second speaker 42 are connected in reverse phase, the sound pressure of each speaker cancels each other in the medium and treble range, and the total sound pressure level is attenuated from above the fundamental resonance frequency $f_2$ of the second speaker.

Therefore, this embodiment provides a speaker system exclusively for bass reproduction, having the band pass characteristic of attenuating from above the fundamental resonance frequency $f_2$ of the second speaker 42. As indicated by frequency characteristic A in FIG. 11, it is known that the band pass characteristic attenuated from above about 155 Hz of the fundamental resonance frequency $f_2$ of the second speaker 42 is obtained.

Besides, since both $Q_1$ and $Q_2$ are large values, a small magnet can be used in both the first speaker unit 41*b* and the second speaker unit 42*b*, so that a further reduction of cost can be attained.

In the embodiment a high range attenuating means is not used in either speaker. However, for example, if the voice coil inductance of the first speaker is large, a choke coil may be inserted in the second speaker in order to align the sound pressure level in the medium and high range.

Of course, a high range attenuating means ,such as a choke coil may be inserted in the parallel connection of both speakers. In such an arrangement, the high range can be further attenuated.

Incidentally, if the output sound pressure level of the second speaker unit 42b itself is higher than the output sound pressure level of the first speaker unit 41b itself at the same input voltage, a resistance or the like may be inserted between the input terminal and the second speaker unit, and the output sound pressure level of the second speaker may be lowered.

Thus, the effects of the fifth exemplary embodiment are exactly the same as explained in the first and third exemplary embodiments. Moreover, since the value of $Q_2$ is a large value so as to satisfy the condition of $Q_1 \times 0.5 \leqq Q_2 \leqq Q_1$, the output sound pressure level of each speaker is close to each other, and the first speaker and second speaker are opposite in polarity. In the medium and treble range, the sound pressure of each speaker cancels, each other from above the fundamental resonance frequency of the second speaker. This embodiment provides a speaker system, exclusively for bass reproduction, having a band pass characteristic high in performance, and low in cost.

The speaker system of the present is not limited to the examples explained in the above exemplary embodiments alone, but maybe changed and modified in various forms. Of course, it should be understood that a wide range of changes and modifications can be made to the preferred embodiment described above and that the foregoing description be regarded as illustrative rather than limiting. It is therefore intended that it is the following claims, including all equivalents, which are intended to define the scope of this invention.

What is claimed is:

1. A speaker system comprising:

a first speaker containing a first speaker unit in a first cavity;

and a second speaker containing a second speaker unit in a second cavity;

wherein the following condition is satisfied, supposing the fundamental resonance frequency of the first speaker is $f_1$, the resonance sharpness is $Q_1$, the fundamental resonance frequency of the second speaker is $f_2$, and the crossover frequency of the first speaker and second speaker is $f_{cr}$:

$$1.4 \leqq Q_1 \leqq 10$$

$$f_1 \leqq f_2$$

$$f_1 \leqq f_{cr} \leqq f_1 \times \{(Q_1^2+1.2\times Q_1)/(Q_1^2-2\ .5)\}^{0.5} \times k$$

$$1 \leqq k \leqq \{(Q_1/(Q_1\ 1.4)\}^{2.5}$$

2. A speaker system of claim 1, further comprising, a network circuit having low range signal attenuating means for at least the second speaker, wherein the lowest impedance of the second speaker as seen from the input terminal side is higher than a DC resistance of the first speaker, wherein the first speaker and second speaker are connected in parallel electrically in mutually reverse phases, and wherein the first speaker and second speaker are integrated.

3. A speaker system of claim 2, wherein the first cavity and second cavity are commonly used.

4. A speaker system of claim 1, wherein the first cavity and second cavity are commonly used.

5. A speaker system comprising;

a first speaker containing a first speaker unit in a first cavity;

a second speaker containing a second speaker unit in a second cavity, being driven together with the first speaker;

and an electric circuit filter as a high range attenuating means for at least the first speaker;

wherein the following condition is satisfied, supposing the fundamental resonance frequency of the first speaker is $f_1$, the resonance sharpness is $Q_1$, the fundamental resonance frequency of the second speaker is $f_2$, the crossover frequency of the first speaker and second speaker is $f_{cr}$, the resonance frequency of the electric circuit filter is $f_L$, and the resonance sharpness is $Q_L$:

$$1.4 \leqq Q_1 \leqq 10$$

$$f_1 \leqq f_2$$

$$f_1 \leqq f_{cr} \leqq f_1 \times \{(Q_1^2+1.2\times Q_1)/(Q_1^2-2.5)\}^{0.5} \times k$$

$$1 \leqq k \leqq \{(Q_1/(Q_1-1.4)\}^{2.5}$$

$$0.7 \leqq Q_L < 5$$

6. A speaker system of claim 5, further comprising, a network circuit having low range signal attenuating means for at least the second speaker, wherein the lowest impedance of the second speaker as seen from the input terminal side is higher than a DC resistance of the first speaker, wherein the first speaker and second speaker are connected in parallel electrically in mutually reverse phases, and wherein the first speaker and second speaker are integrated.

7. A speaker system of claim 6, wherein the first cavity and second cavity are commonly used.

8. A speaker system of claim 5, wherein the first cavity and second cavity are commonly used.

9. A speaker system of any one of claims 1 to 8, wherein the following condition is satisfied, supposing the resonance sharpness of fundamental resonance frequency of the second speaker is $Q_2$, the output sound pressure level of the first speaker is $L_1$, and the output sound pressure level of the second speaker is $L_2$, both at the same input voltage:

$$Q_1 \times 0.5 \leqq Q_2 \leqq Q_1$$

$$L_2 = L_1 \pm 5dB$$

* * * * *

UNITED STATES PATENT AND TRADEMARK OFFICE

CERTIFICATE OF CORRECTION

PATENT NO. : 5,781,642

DATED : July 14, 1998

INVENTOR(S) : TANAKA et al.

It is certified that error appears in the above-identified patent and that said Letters Patent is hereby corrected as shown below:

Col. 17, line 52: Delete "$\leqq$" and insert --$<$--

Col. 17, line 56: Delete "($Q_1$ 1.4)" and insert --($Q_1$-1.4)--

Col. 18, line 29: Delete "$\leqq$" and insert --$<$--

Col. 18, line 34: Delete "$<$" and insert --$\leqq$--

Col. 18, line 35: Insert --$f_1 f_L$--

Signed and Sealed this

Seventeenth Day of November, 1998

*Attest:*

Bruce Lehman

BRUCE LEHMAN

*Attesting Officer*

*Commissioner of Patents and Trademarks*